US011300004B2

(12) United States Patent
Stiehler

(10) Patent No.: US 11,300,004 B2
(45) Date of Patent: Apr. 12, 2022

(54) ADJUSTABLE GUIDE VANE ARRANGEMENT, GUIDE VANE, SEAL CARRIER AND TURBOMACHINE

(71) Applicant: MTU Aero Engines AG, Munich (DE)

(72) Inventor: Frank Stiehler, Bad Liebenwerda (DE)

(73) Assignee: MTU Aero Engines AG, Munich (DE)

( * ) Notice: Subject to any disclaimer, the term of this patent is extended or adjusted under 35 U.S.C. 154(b) by 82 days.

(21) Appl. No.: 16/542,457

(22) Filed: Aug. 16, 2019

(65) Prior Publication Data

US 2020/0056499 A1 Feb. 20, 2020

(30) Foreign Application Priority Data

Aug. 20, 2018 (DE) ..... 10 2018 213 983.0

(51) Int. Cl.
*F01D 9/04* (2006.01)
*F01D 17/16* (2006.01)
*F01D 11/00* (2006.01)

(52) U.S. Cl.
CPC ..... *F01D 17/162* (2013.01); *F01D 9/042* (2013.01); *F01D 11/001* (2013.01); *F05D 2220/32* (2013.01); *F05D 2240/12* (2013.01); *F05D 2240/55* (2013.01)

(58) Field of Classification Search
CPC ..... F01D 17/162; F01D 9/042; F01D 11/001; F05D 2220/32; F05D 2240/12; F05D 2240/55
See application file for complete search history.

(56) References Cited

U.S. PATENT DOCUMENTS 3,079,128 A * 2/1963 Burge ..... F01D 17/162 415/191
3,314,654 A * 4/1967 Thenault ..... F01D 17/162 415/160
3,367,628 A * 2/1968 Fitton ..... F01D 17/16 415/110
4,150,915 A 4/1979 Karstensen
4,514,141 A 4/1985 Marey
(Continued)

FOREIGN PATENT DOCUMENTS

DE 102009038623 A1 3/2011
EP 2031188 A1 3/2009
(Continued)

*Primary Examiner* — J. Todd Newton, Esq.
*Assistant Examiner* — Theodore C Ribadeneyra
(74) *Attorney, Agent, or Firm* — Barlow, Josephs & Holmes, Ltd.; David R. Josephs

(57) ABSTRACT

A guide vane arrangement for a turbomachine, wherein the guide vane arrangement has a plurality of adjustable guide vanes that are rotatably mounted around an adjustment axis, at least one inner ring segment that is formed separately from the guide vanes, and a seal carrier that is formed separately from the at least one inner ring segment, wherein the at least one inner ring segment is fastened to one guide vane or to a plurality of guide vanes, and wherein the seal carrier is mounted in a spoke-centered manner with respect to the at least one inner ring segment, so that the seal carrier is movably mounted with respect to the at least one inner ring segment in the direction of at least one adjustment axis of at least one guide vane.

13 Claims, 2 Drawing Sheets

(56) References Cited

Figure 1:
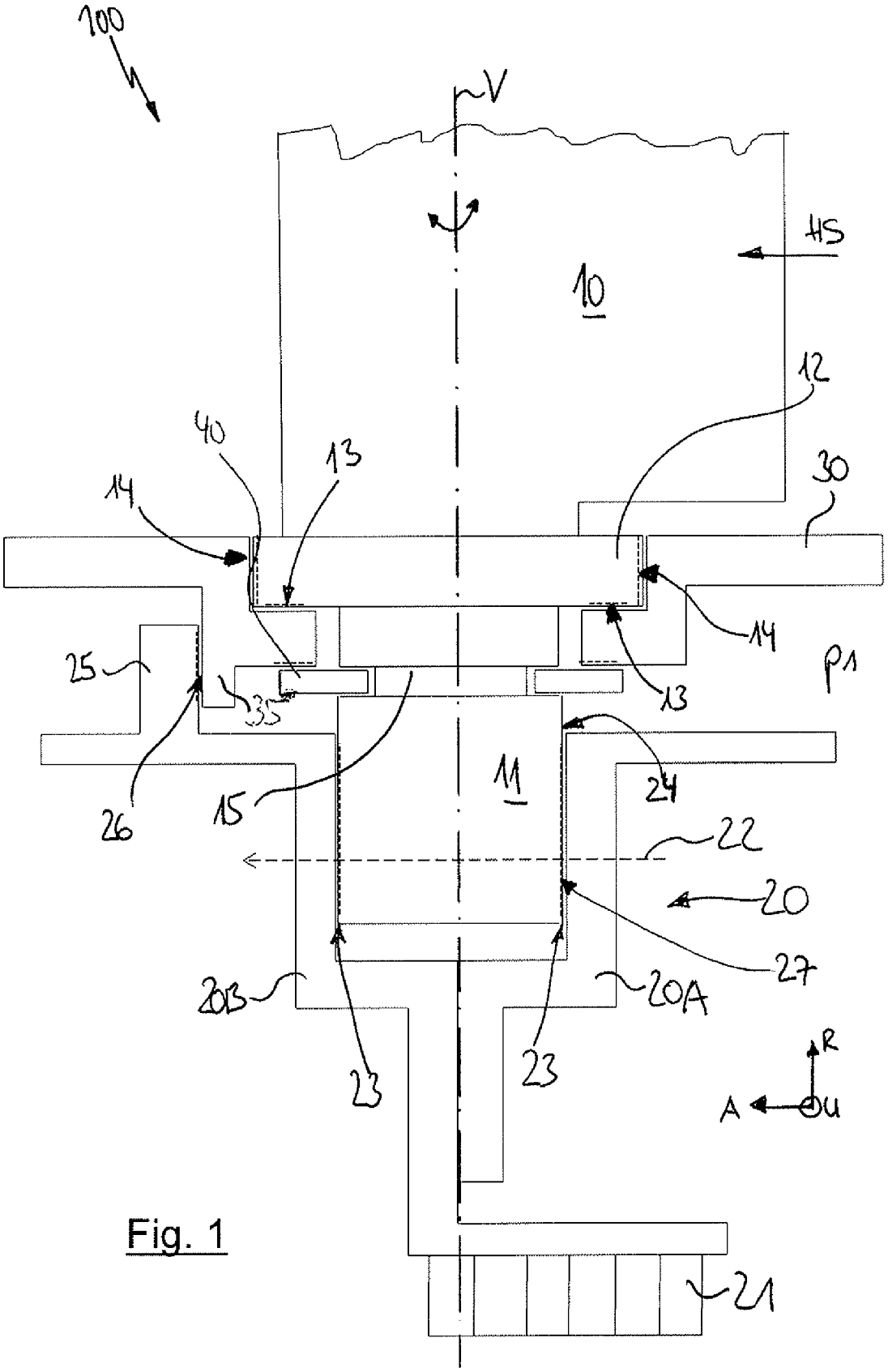

U.S. PATENT DOCUMENTS 4,604,030 A * 8/1986 Naudet ..... F01D 11/001 415/126
4,706,354 A * 11/1987 Naudet ..... F01D 17/162 29/428
4,861,228 A * 8/1989 Todman ..... F01D 17/162 415/115
4,990,056 A * 2/1991 McClain ..... F01D 11/001 29/889.22
5,421,703 A * 6/1995 Payling ..... F01D 9/042 415/209.3
5,636,968 A * 6/1997 Audet ..... F01D 17/162 415/160
6,129,512 A * 10/2000 Agram ..... F01D 17/162 415/160
6,783,323 B2 8/2004 Shiozaki et al.
7,588,415 B2 * 9/2009 Giaimo ..... F04D 27/0246 415/160
7,753,647 B2 * 7/2010 Giaimo ..... F01D 17/162 415/160
9,605,549 B2 * 3/2017 Humhauser ..... F01D 11/003
10,364,827 B2 * 7/2019 Humhauser ..... F01D 7/00
10,494,937 B2 * 12/2019 Tomsik ..... F01D 9/042
2005/0084190 A1 4/2005 Brooks et al.
2007/0059161 A1 * 3/2007 Bouru ..... F04D 29/563 415/160
2011/0293406 A1 * 12/2011 Abadie ..... F01D 17/162 415/160
2015/0192025 A1 * 7/2015 Boeck ..... F01D 9/04 415/173.7
2017/0234152 A1 8/2017 Jones et al.
2017/0261003 A1 9/2017 Mouton et al.

FOREIGN PATENT DOCUMENTS

EP 2696039 A1 2/2014
EP 2696043 A1 2/2014
EP 2722485 A1 4/2014
EP 2884054 A1 6/2015
GB 853314 A 11/1960

* cited by examiner

ADJUSTABLE GUIDE VANE ARRANGEMENT, GUIDE VANE, SEAL CARRIER AND TURBOMACHINE

BACKGROUND OF THE INVENTION

The present invention relates to a guide vane arrangement for a turbomachine with an axis of rotation, in particular for a compressor stage or turbine stage of a gas turbine, wherein the guide vane arrangement comprises a plurality of adjustable guide vanes that are rotatably mounted around an adjustment axis, at least one inner ring segment that is formed separately from the guide vanes, and a seal carrier that is formed separately from the at least one inner ring segment.

The present invention further relates to a guide vane, in particular an adjustable guide vane, for an aforementioned guide vane arrangement as well as to a seal carrier for such a guide vane arrangement.

Furthermore, the present invention relates to a turbomachine, in particular a gas turbine, having at least one compressor stage or turbine stage with at least one guide vane arrangement.

During the operation of turbomachines with generic guide vane arrangements, the guide vane arrangements are exposed to thermal loads, among other things, in particular to partly changing and/or high-temperature gradients, in particular due to the working fluid that flows through the guide vane arrangement and hence at least partially flows against and/or around the inner ring segments and/or due to seals, in particular contact seals that are arranged in the radial direction between the guide vanes and a rotor that rotates relative to them. The thermal loads can result in undesired, thermally caused deformations of parts of the guide vane arrangement and, in particular, they can result in a change in length of the guide vanes and in an expansion of the inner ring segments or of an inner ring formed from them as well as of the seal carrier in the peripheral direction.

This can lead, in particular, to a widening of gaps between the individual structural parts, in particular between the guide vanes and the inner ring or the corresponding inner ring segments, as well as between a sealing structure held by the seal carrier and the rotor, and, in consequence thereof, can lead to undesired leakages, which can have a detrimental effect on the efficiency of the turbomachine.

The sealing effect that can be achieved in each case thereby depends decisively on the gap widths of the respective sealing gaps that are adjusted during operation. As a rule, the larger the ensuing sealing gaps are, the larger are the leakages that occur and, in consequence thereof, the larger are the losses in efficiency that occur.

The sealing effect that can be achieved overall thereby depends, in particular, on the one hand, on whether the guide vanes are each connected at their radially inner end to the inner ring or to corresponding inner ring segments, and on how the seal carrier, to which, as a rule, a sealing structure is fastened in order to seal a annular gap around the rotor, is designed and mounted.

Known from the prior art are different concepts for guide vane arrangements, whereby a fundamental distinction is to be made between concepts for guide vane arrangements having fixed guide vanes, that is, non-adjustable guide vanes, and concepts for guide vane arrangements having adjustable guide vanes, and whereby, both for guide vane arrangements having fixed guide vanes and for guide vane arrangements having adjustable guide vanes, there are different concepts in each case for the attachment or connection between the guide vanes and the inner ring or corresponding inner ring segments, as well as in terms of the attachment and mounting of the seal carrier.

Known from EP 2 722 485 A1 is, for example, a guide vane arrangement having adjustable guide vanes, in which the inner ring has at least one groove that extends in the axial direction and in which the seal carrier engages with a guide rail for fastening at the inner ring.

Further known from internal operating practice are guide vane arrangements having adjustable guide vanes in which the seal carrier is formed integrally with the inner ring or with corresponding inner ring segments.

Beyond this, guide vane arrangements having fixed guide vanes are known for example, from EP 2 696 039 A1—in which the seal carrier is mounted at the inner ring in a spoke-centered manner.

SUMMARY OF THE INVENTION

An object of one embodiment of the present invention is to make available an alternative guide vane arrangement, in particular an improved guide vane arrangement, in which, in particular, the gap widths of the individual sealing gaps undergo less change during operation, and which, in consequence thereof, makes possible, in particular, larger tolerance ranges as well as, in particular, additionally, a simpler determination of the maximum allowed tolerances for a desired operating behavior. Another object of the invention is, moreover, to make available an alternative guide vane, in particular an improved guide vane, as well as an alternative seal carrier, in particular an improved seal carrier, for a guide vane arrangement, as well as an alternative turbomachine, in particular an improved turbomachine.

This object is achieved by a guide vane arrangement, by a guide vane, by a seal carrier, and by a turbomachine of the present invention. Advantageous embodiments of the invention are discussed in detail below.

In accordance with one embodiment of the present invention, a guide vane arrangement according to the invention for a turbomachine with an axis of rotation, in particular for a compressor stage or turbine stage of a gas turbine, comprises a plurality of adjustable guide vanes, which are each rotatably mounted around an adjustment axis, at least one inner ring segment that is formed separately from the guide vanes, and a seal carrier that is formed separately from the at least one inner ring segment, wherein the at least one inner ring segment is fastened to one guide vane or to a plurality of guide vanes, in particular to at most four guide vanes.

In accordance with the invention, the seal carrier is mounted in a spoke-centered manner with respect to the at least one inner ring segment, so that the seal carrier is movably mounted with respect to the at least one inner ring segment in the direction of at least one adjustment axis of at least one guide vane and/or in the radial direction in relation to the axis of rotation of the turbomachine in a functional state of use of the guide vane arrangement in a turbomachine.

An "adjustable guide vane" is understood in the sense of the present invention to mean a guide vane that is designed and, in particular, is mounted in the guide vane arrangement in such a way that it can be adjusted by rotation around an adjustment axis and, in particular, its inflow angle of attack can thus be adjusted, whereby the adjustment axis can coincide with its longitudinal axis or else can be different from its longitudinal axis, whereby the adjustment axis extends, in particular, essentially in the longitudinal direction of the guide vane.

A "seal carrier" in the sense of the present invention is understood to mean a bearing structure that is designed to hold a sealing structure, in particular a sealing structure that is fundamentally known from the prior art, such as, for example, a brush seal structure and/or a so-called "honeycomb" structure, which is also fundamentally known from the prior art and is used in turbomachines.

A "spoke-centered mounting" is understood in the sense of the present invention to mean a mounting that is designed in such a way that the respective structural part that is mounted in this manner the seal carrier, in particular, in the present case is always oriented in a centered manner around an axis, in particular around an axis that extends parallel to the axis of rotation of a turbomachine or around the axis of rotation itself, and which, in addition, makes possible a compensation in the radial direction in relation to the axis of rotation of a turbomachine. That is, in other words, a spoke-centered mounting in the sense of the present invention is understood to mean, in particular, a mounting that, in particular, has a degree of freedom in the radial direction and acts in a self-centering manner with respect to an axis, in particular with respect to an axis that extends parallel to the axis of rotation of a turbomachine or to the axis of rotation itself, similarly to a wheel of a bicycle in which the hub is mounted in the rim by way of spokes.

In the present case, in the conventional technical way, insofar as something different is not explicitly specified, particularly another axis, the directional specification "axially" refers to a direction parallel to a main axis of rotation or (main) machine axis of the turbomachine, the directional specification "peripheral direction" refers correspondingly, insofar as something different is not explicitly specified, particularly another axis, to a direction of rotation around this axis of rotation or (main) machine axis, and the directional specification "radially" refers, insofar as something different is not explicitly specified, particularly another axis, to a direction that is perpendicular to the axial direction and to the peripheral direction. The directional specification "tangentially" refers correspondingly, insofar as something different is not explicitly specified, particularly another axis, to a direction that is perpendicular to the axial direction in accordance with the aforementioned definition and that is perpendicular to the radial direction in accordance with the aforementioned definition, whereby, in particular, all directional specifications, insofar as something different is not explicitly specified, are each given in relation to a functional state of installation of the corresponding structural parts in a turbomachine.

The spoke-centered mounting of the seal carrier in accordance with the invention makes it possible to decouple the sealing, in the region of the radial inner ends of the guide vanes, between the guide vanes and the at least one inner ring segment, from the sealing with respect to the rotor.

In particular, by means of the spoke-centered mounting of the seal carrier in accordance with the invention, it is possible, particularly owing to the degree of freedom in the radial direction, to achieve a decoupling of the mounting of the seal carrier in the radial direction from the at least one inner ring segment. In consequence of this, it is possible to design and adjust at least one sealing gap between the guide vane and the at least one inner ring segment independently of the seal carrier and thus also independently of a ring and rotor. That is, a change in length of the guide vanes, in particular a thermally caused change in length of the guide vanes, no longer necessarily leads to a change in the gap width of the sealing gap between the seal carrier or a sealing structure fastened at it and the rotor, and a change in the length of the seal carrier, in particular a thermally caused change in the length of the seal carrier in the peripheral direction, or a change in its diameter no longer necessarily leads to a change in a gap width between an inner ring segment and at least one guide vane.

A guide vane arrangement according to the invention further has the advantage that the gap between a sealing structure fastened at the seal carrier and the rotor can be designed and adjusted nearly independently of the at least one inner ring segment and its fastening to the respective guide vanes. In this way, any ensuing sealing gaps between the at least one inner ring segment and the guide vanes to which the inner ring segment is fastened can be designed separately from and independently of the sealing gap between the seal carrier or a sealing structure fastened at it and the rotor, as a result of which the tolerance chains to be taken into consideration in each case are shortened and, in particular, are divided up and simplified in consequence thereof, and, furthermore, overall fewer narrow tolerances need to be maintained.

In an embodiment of the present invention, a guide vane arrangement according to the invention has, in particular, a plurality of adjustable guide vanes that are arranged in a distributed manner in the peripheral direction, in particular in a uniformly distributed manner in the peripheral direction, each of which is rotatably mounted around an adjustment axis.

In one embodiment of a guide vane arrangement in accordance with the present invention, at least one guide vane is thereby arranged in such a way that, in a functional state of use of the guide vane arrangement in a turbomachine, its adjustment axis is inclined in the upstream direction by more than 1°, preferably by more than 2°, in particular by more than 3°, at most, however, by 5°, in particular at most by 4°, preferably at most by 3°, from a radial plane that extends perpendicular to the axis of rotation of a turbomachine. It is thereby possible to achieve an especially advantageous kinematics and an especially advantageous flow behavior, but, nonetheless, to maintain enough play in the radial direction for an advantageous spoke-centered mounting of the seal carrier in accordance with the invention.

In one embodiment of a guide vane arrangement in accordance with the present invention, in particular, each guide vane is assigned a separate inner ring segment.

In an alternative embodiment of a guide vane arrangement in accordance with the present invention, a plurality of guide vanes, in particular two or three guide vanes, in particular, however, at most four guide vanes, are assigned to a common inner ring segment. That is, in an alternative embodiment of the present invention, an inner ring segment is fastened to a plurality of guide vanes, but particularly to at most four guide vanes. Although the fastening to more than four guide vanes is possible, if the inner ring segment is fastened to too many guide vanes, this can result in thermally caused stresses, which can be countered only by larger gap dimensions between the inner ring segment and the guide vanes, as a result of which the sealing effect becomes poorer in most cases and this can be detrimental to the efficiency and should therefore be avoided.

In one embodiment of a guide vane arrangement in accordance with the present invention, the guide vane arrangement comprises a plurality of inner ring segments, which, in particular, are arranged next to one another in the peripheral direction and, in particular, form an inner ring.

The individual inner ring segments are formed, in particular, in such a way that they have a type of shroud that serves to delimit a flow channel, in particular radially inward, and that surrounds the guide vanes in the region of their flow profiles, whereby the individual inner ring segments are formed, in particular, in such a way that an inner shroud, which is nearly closed in the peripheral direction, is formed. In order to prevent, in particular, thermally caused stresses from arising in the peripheral direction, however, the individual inner ring segments are particular arranged sufficiently spaced apart from one another in the peripheral direction.

In one embodiment of a guide vane arrangement in accordance with the present invention, the seal carrier has, in particular at its radially inner end, in relation to a functional state of use of the guide vane arrangement in a turbomachine, at least one sealing structure, in particular at least one brush sealing structure and/or at least one honeycomb sealing structure for sealing with respect to a rotor that is mounted so as to rotate around an axis of rotation.

In an enhancement of a guide vane arrangement in accordance with the present invention, at least one sealing structure is thereby formed integrally, that is, in one piece, with the seal carrier.

In another embodiment of a guide vane arrangement in accordance with the present invention, the seal carrier is mounted in this case, in particular, in a spoke-centered manner at the guide vanes and/or at the at least one inner ring segment, in particular by way of at least three bearing points that are arranged in a distributed manner in the peripheral direction, particularly in a uniformly distributed manner.

In an especially advantageous embodiment of a guide vane arrangement in accordance with the present invention, the seal carrier is thereby mounted only at the guide vanes in a spoke-centered manner.

As a result of this, it is possible to achieve a complete decoupling from the at least one inner ring segment and, in particular, from all inner ring segments and thus a decoupling of the sealings/guide vane(s)—inner ring segment and the seal carrier/seal structure—rotor.

In another advantageous embodiment of a guide vane arrangement in accordance with the present invention, at least one guide vane has at its radially inner end a fastening element that extends along the adjustment axis, in particular a fastening pin, and the at least one inner ring segment that is fastened to this at least one guide vane has at least one associated, correspondingly formed fastening opening, in which, in particular in the direction of the adjustment axis, the fastening element of the guide vane engages, particularly all the way through the at least one associated fastening opening of the inner ring segment.

It is thereby possible to realize an especially advantageous spoke-centered mounting of the seal carrier at the guide vanes. In particular, it is possible in this way to achieve an especially advantageous embodiment of a guide vane arrangement, because, in this way, it is possible to achieve in an especially simple manner both a fastening of the at least one inner ring segment to one guide vane or to a plurality of guide vanes as well as, at the same time, to achieve a spoke-centered mounting of the seal carrier at the guide vanes, namely, at the radially inner ends of the guide vanes, which engage all the way through the fastening openings.

Through the spoke-centered, radially movable mounting of the seal carrier at the guide vanes and thus, in particular, the decoupling from the at least one inner ring segment, it is possible to compensate for a thermally caused change in length of the guide vanes, without any notable increase in the sealing gap between the sealing structure fastened to the seal carrier and the rotor. Because, in accordance with the invention, the at least one inner ring segment is fastened to the guide vanes, it follows the change in length of the guide vanes, so that, in addition, an enlargement of the sealing gap between the guide vanes and the inner ring segment can be avoided.

Alternatively or additionally, the seal carrier can also be mounted at the inner ring segments, in particular at least three inner ring segments, in a spoke-centered manner, such as is known, for example, from the prior art for a guide vane arrangement having fixed guide vanes and such as is described, for example, in EP 2 696 039 A1, whereby the corresponding radial grooves are arranged in this case, in particular, in the peripheral direction between the fastening elements of the guide vanes.

In one embodiment of a guide vane arrangement in accordance with the present invention, at least one inner ring segment is fastened to the fastening element of the guide vane by means of an axial retaining means and retained on the fastening element in the direction of the adjustment axis, in particular with a defined play in the direction of the adjustment axis, particularly by means of a retaining ring or a retaining washer.

In another embodiment of a guide vane arrangement in accordance with the present invention, the at least one inner ring segment in this case is fastened to one guide vane or to a plurality of guide vanes with a defined play in the direction of the adjustment axis in such a way that, by means of a sufficient operating pressure present in a region radially within the inner ring segment, the inner ring segment can be displaced outward in the scope of this play in the direction of the adjustment axis, particularly in such a way that the inner ring segment can be brought in the radial direction to rest against the guide vanes belonging thereto, so that a sealing can be created in the radial direction between these associated guide vanes and the inner ring segment, in particular with a sealing gap having a gap width of zero in the radial direction.

In order to achieve an especially good sealing effect between the inner ring segment and the associated guide vanes, in particular when the inner ring segment rests against the associated guide vanes in the radial direction or in the direction of the adjustment axis, the associated guide vanes as well as the inner ring segment have, in particular, a correspondingly formed shoulder and functional surface or a plurality of correspondingly formed shoulders and functional surfaces (particularly sealing surfaces) that extends or extend, in particular, radially to the adjustment axis.

In another embodiment of a guide vane arrangement in accordance with the present invention, the at least one inner ring segment is fastened in this case to the respective guide vanes, in addition, with a defined play in the axial direction and/or in the peripheral direction. Stresses, in particular thermally caused stresses, can thereby be prevented.

The guide vane is directed in the axial direction and/or in the peripheral direction in the case of a guide vane arrangement according to the invention, in particular, by way of the fastening elements of the guide vanes that are accommodated by the seal carrier, whereby, for this purpose, the play between the guide vanes and the at least one inner ring segment in the axial direction and/or in the peripheral direction is, in particular, greater than that between the guide vanes and the seal carrier in these directions.

In one embodiment of a guide vane arrangement in accordance with the present invention, the seal carrier has at least one guide vane mount, in which the fastening element, in particular a fastening pin, of at least one guide vane can engage in such a way that the fastening element of the guide vane is mounted movably in the guide vane mount of the seal carrier with respect to the seal carrier along the adjustment axis and/or in the radial direction in relation to the axis of rotation in a state of use of the guide vane arrangement in accordance with the invention in a turbomachine, wherein the guide vane mount in the seal carrier is formed and arranged, in particular, concentrically to at least one fastening opening of at least one inner ring segment.

It is thereby possible in an especially simple manner for the fastening element of at least one guide vane to be movably mounted in the direction of the adjustment axis of the guide vane or in the radial direction, but, at the same time, to be directed, in particular, in the axial direction and in the peripheral direction in relation to the axis of rotation of a turbomachine. It is thereby possible to create an especially advantageous spoke-centered mounting of the seal carrier. The spoke centering by use of fastening pins thereby makes it possible, in particular in comparison to a groove-directed spoke centering, such as is known, for example, from EP 2 696 039 A1, to achieve a more precise directing and thus an improved, in particular a more precise, centering. It is thereby possible to adjust the gap widths more precisely.

In a preferred embodiment of a guide vane arrangement in accordance with the present invention, the at least one guide vane mount is designed as a cylindrical or cup-shaped or cylinder-like or cuplike depression. Alternatively, at least one guide vane mount can also be designed as a truncated-cone-shaped or cone-shaped depression, whereby the fastening element that is provided for mounting in the guide vane mount, in particular the respective fastening pin, is designed, in particular, appropriately correspondingly to the configuration of the guide vane mount, particularly correspondingly complementary to the configuration of the guide vane mount.

In one embodiment of a guide vane arrangement in accordance with the present invention, the fastening element of the guide vane engages, in particular in the direction of the adjustment axis, particularly with defined play in the axial direction and/or in the peripheral direction, in the guide vane mount of the seal carrier, wherein the play in the direction of the adjustment axis is dimensioned particularly at least large enough that a thermally caused increase in length of the guide vane is possible during operation in a stress-free manner. It is self-evident that, in each case, the play should be chosen to be at most so large that, during operation, the seal carrier is always mounted securely at the guide vanes and, in particular, the possibility of the fastening element slipping out of guide vane mounts in the seal carrier is excluded.

In an alternative, but also conceivable embodiment of a guide vane arrangement in accordance with the present invention, the fastening element, in particular in the form of a fastening pin, can also be assigned to the seal carrier, and one guide vane or a plurality of guide vanes can each have a corresponding mount for the fastening element, in this case a "seal carrier mount."

The seal carrier of a guide vane arrangement according to the invention can be formed in one piece or in multiple pieces and, in particular, can be axially divided in the peripheral direction and/or in the axial direction or in a direction perpendicular to the adjustment axis of at least one guide vane and, in particular, of all guide vanes, wherein, in the case of a divided seal carrier, the individual parts are preferably connected to one another by way of detachable connection means, in particular by means of screws or the like.

In one embodiment of a guide vane arrangement in accordance with the present invention, the seal carrier is a circumferentially formed seal carrier ring, wherein the seal carrier ring is formed in one piece in the peripheral direction or else has a plurality of seal carrier segments, each of which extends over only one part in the peripheral direction, wherein the seal carrier is composed, in particular, of a plurality of seal carrier segments, each of which extends over only one part in the peripheral direction.

The division of the seal carrier in the peripheral direction makes possible an especially simple mounting of a guide vane arrangement according to the invention, whereby the individual seal carrier segments are arranged in an overlapping manner, in particular in the peripheral direction, that is, preferably by means of an overlap joint and not a butt joint, and the overlapping surfaces are each formed, in particular, as wedge-shaped surfaces. It is thereby possible to achieve an especially good sealing in the axial direction at the seal carrier. Furthermore, it is possible in this way to achieve an advantageous force flux in the seal carrier.

In an enhancement of a guide vane arrangement in accordance with the present invention, at least one seal carrier segment or seal carrier part is produced by an additive manufacturing method, wherein, in this case, the seal carrier segments no longer extend, in particular, over more than a peripheral angle of 60°. The production by an additive manufacturing method makes possible an especially flexible embodiment of the seal carrier, because this kind of production makes possible an especially large geometric freedom and, at the same time, good mechanical and thermal properties.

In one embodiment of a guide vane arrangement in accordance with the present invention, the seal carrier is divided, particularly in a seal carrier ring or at least one seal carrier segment, into at least one upstream seal carrier part and at least one downstream seal carrier part, wherein the seal carrier is divided, in particular at least in part along a plane of division that extends parallel to the adjustment axis of the guide vanes and/or along a radial plane that extends perpendicular to the axis of rotation, into a upstream seal carrier part and a downstream seal carrier part.

This makes possible an especially simple introduction of the guide vane mounts into the seal carrier as well as an especially simple mounting.

In an especially advantageous embodiment of a guide vane arrangement in accordance with the present invention, the seal carrier is divided both in the peripheral direction into seal carrier segments and into an upstream and a downstream seal carrier part, wherein at least one seal carrier part or at least one seal carrier segment is produced by an additive manufacturing method and/or extends, in particular, in the peripheral direction at most over a region of a peripheral angle of 60°.

In an enhancement of a guide vane arrangement in accordance with the present invention, the at least one upstream seal carrier part and the at least one downstream seal carrier part are connected to each other by way of at least one means of connection, in particular by means of at least one screw or by means of a rivet or the like, particularly in a detachable manner, in particular by way of at least one connection means that extends in a direction perpendicular to the plane of division of the seal carrier, wherein, in relation to a state of use of the guide vane arrangement in accordance with the invention in a turbomachine, the at least one connection means is arranged displaced in the peripheral direction with respect to the fastening elements of the guide vanes and, in relation to the axis of rotation of the turbomachine, is situated in the radial direction, in particular at the level at least one fastening element of at least one guide vane.

In particular, screws can be used to rapidly assemble the individual seal carrier parts into seal carriers, particularly in a detachable manner.

In this case, if the connection means are each arranged in the radial direction at the level of the fastening elements, in particular at the level of the fastening pin, it is possible to create an especially compact, space-saving guide vane arrangement in the radial direction.

In another embodiment of a guide vane arrangement in accordance with the present invention, at least one inner ring segment and the seal carrier overlap at least in part, in particular downstream, in relation to a functional state of installation in a turbomachine, in the direction of the adjustment axis or in the radial direction and form, particularly between them, a sealing gap that acts in a sealing manner in the axial direction, in relation to the axis of rotation of a turbomachine in a functional state of use of the guide vane arrangement, wherein the sealing gap itself extends, in particular, parallel to the adjustment axis of at least one guide vane, particularly parallel to the adjustment axis of the nearest-lying guide vane, or in the radial direction.

In this way, it is possible in an especially simple manner, in particular additionally, to create a sealing that acts in the axial direction, particularly downstream of the guide vane mounts, and, in particular, in addition, makes possible a length compensation of the guide vane or a radial movement of the inner ring segment with respect to the seal carrier, without any notable negative influence on the sealing effect in the axial direction. The additional sealing makes it possible to reduce leakage effects still further and, as a rule, this acts advantageously on the efficiency of a turbomachine.

In order to bring about the axial sealing, the at least one inner ring segment and the seal carrier, in particular a downstream part of the seal carrier and, particularly in each case, downstream of the respective guide vane mount, have, in each case, a sealing flange that, in relation to the axis of rotation of a turbomachine, extends in the radial direction, wherein the sealing flange of the inner ring segment extends, in particular, radially inward and the sealing flange of the seal carrier extends, in particular, radially outward.

An especially good sealing in the axial direction can be achieved when the at least one inner ring segment is fastened to the respective guide vane with a defined play in the axial direction and the play is dimensioned such that, by means of a sufficient operating pressure that is present in a region radially within the inner ring segment, the inner ring segment can be brought in the axial direction in the scope of this play to rest with its sealing flange against the sealing flange of the seal carrier, in particular in such a way that, in the axial direction, a sealing of the inner ring segment and the seal carrier can be brought about, in particular with a sealing gap having a gap width of zero in the axial direction.

In another embodiment of a guide vane arrangement in accordance with the present invention, the guide vane arrangement has at least two inner ring segments that are formed separately from the guide vanes, wherein the at least two inner ring segments are arranged next to one another in the peripheral direction and are arranged with a compensation gap in the peripheral direction in between, wherein, in relation to the axis of rotation of a turbomachine, the compensation gap extends, in particular, in the radial direction, wherein, between two inner ring segments that are arranged next to each other in the peripheral direction, at least one sealing element, in particular, is arranged in the region of the compensation gap, particularly for at least a partial sealing of the compensation gap in the radial direction.

The compensation gaps make it possible to reduce stresses in the peripheral direction, in particular thermally caused stresses resulting from thermally caused expansions of the inner ring segments, or even to prevent them entirely if correspondingly large compensation gaps are chosen.

By means of the at least one sealing element arranged in the compensation gap, it is possible to reduce leakages in this region and, in particular, to improve the sealing radially inward and this has an advantageous effect on the efficiency.

In this case, at least one sealing element extends, in particular, in the peripheral direction and at least in part in the axial direction, wherein at least one sealing element is, in particular, a sealing strip, in particular a metal strip or the like, in particular a metal strip made of spring steel, which, in particular, is accommodated in each case in a correspondingly formed groove of two respective inner ring segments that adjoin each other, particularly in such a way that, in each case, a labyrinth gap is formed between the sealing element and the respective inner ring segment.

In a guide vane according to the invention for a turbomachine, which, in particular, is an adjustable guide vane, particularly for a compressor stage or turbine stage of a gas turbine, in particular for a guide vane arrangement according to the invention, wherein the guide vane, in relation to a functional state of installation of the guide vane in a turbomachine and in relation to an axis of rotation of the turbomachine, has a radially outer end and a radially inner end, wherein, in the region of the radially inner end of the guide vane, an inner ring segment can be fastened to the guide vane and, at its radially inner end, the guide vane has a fastening pin that extends along an adjustment axis and, for this purpose, is designed to interact with a fastening recess, in particular a fastening opening, of an inner ring segment that can be fastened to the guide vane, in particular to engage all the way through a fastening opening; a radial groove, in particular a circumferential radial groove, in each case in relation to the adjustment axis, is introduced into the fastening pin in accordance with the invention for receiving an axial retaining means, in particular a retaining ring or a retaining washer.

This makes possible, in a totally simple and robust manner, a fastening of an inner ring segment to the guide vane.

In one embodiment of a guide vane in accordance with the present invention, the fastening pin of the guide vane abuts, by its radially further outer-lying end, in relation to the axis of rotation of a turbomachine, a shoulder with a larger outer diameter, in relation to the axis of rotation of a turbomachine, wherein the circumferential radial groove, in relation to the adjustment axis, is introduced into the fastening pin for receiving the axial retaining means at a defined separating distance from this shoulder of the guide vane in the direction of the radial further inner-lying end of the fastening pin.

It is thereby possible in an especially simple manner to accomplish the fastening of an inner ring segment to the guide vane, in particular with a defined play in the direction of the adjustment axis or with a defined play in the radial direction, in relation to an axis of rotation of a turbomachine.

In another embodiment of a guide vane in accordance with the present invention, the shoulder has an end face that faces the radially inner end of the guide vane and extends in a radial plane perpendicular to the adjustment axis, wherein the end face is formed at least in part and preferably in full as a sealing surface.

It is thereby possible in an especially simple manner to achieve a good sealing between the guide vane and the at least one inner ring segment in the radial direction in relation to an axis of rotation or in the direction of the adjustment axis, as a result of which leakages can be reduced and the efficiency can be advantageously influenced.

In an advantageous embodiment of a guide vane in accordance with the present invention, in this case, a peripheral surface of the fastening pin faces away from the shoulder and the radial further inner-lying end of the fastening pin or the side of the groove that faces the radially inner end of the guide vane at least in part, preferably in full, is formed as a functional surface, in particular as a guide surface, in particular as a sliding bearing surface. The functional surface is thereby formed, in particular, for guiding the fastening pin in a guide vane mount of a seal carrier, in particular for guiding the fastening pin in a seal carrier according to the invention, wherein the guide surface can have a functional coating, in particular a coating that reduces the friction coefficient and/or a coating for increasing a surface hardness, in particular in order to avoid fretting (rubbing wear) and/or to reduce it or even totally prevent it.

It is thereby possible in an especially simple manner to achieve a good guiding of the guide vane in a seal carrier in the direction of the adjustment axis or in the radial direction in relation to the axis of rotation of a turbomachine.

Furthermore, a guide vane designed in this way makes it possible by way of different functional surfaces (end face of the shoulder for sealing in the radial direction with respect to an inner ring segment, peripheral surface of the fastening pin for guiding in the axial direction and peripheral direction) to separate the sealing in the radial direction (via the end face of the shoulder) and a guiding in the direction of the adjustment axis (via the peripheral surface of the fastening pin) and the sealing with respect to the rotor. It is thereby possible, on the one hand, to achieve an especially good sealing between the guide vanes and an associated inner ring segment that is fastened to the guide vanes, wherein, in particular, a sealing gap in the direction of the adjustment axis and/or in the radial direction in relation to the axis of rotation of a turbomachine is nearly independent of the current length of the guide vane, that is, it does not notably change, even as a result of a change in length of the guide vane under the influence of temperature and, in particular, is not notably enlarged. On the other hand, a sealing gap between a sealing structure held by the seal carrier and the rotor can also be adjusted nearly independently of a current guide vane length and thus independently of any thermally caused changes in length of the guide vane that occur during operation.

A seal carrier according to the invention for a guide vane arrangement, in particular for a guide vane arrangement with adjustable guide vanes, particularly of a compressor stage or turbine stage of a gas turbine, in particular for a guide vane arrangement according to the invention, is designed for spoke-centered mounting in a guide vane arrangement and, in accordance with the invention, has at least one guide vane mount for mounting a fastening element, in particular a fastening pin, of an adjustable guide vane, in which the fastening element, in particular a fastening pin, of a guide vane can engage in such a way that the fastening element of the guide vane can be movably displaced in the guide vane mount of the seal carrier with respect to the seal carrier along an adjustment axis or longitudinal axis of the guide vane and/or in the radial direction in relation to an axis of rotation of a turbomachine in a functional state of use of the seal carrier in a turbomachine and, in particular, in addition, can rotate around the adjustment axis. It is thereby possible in an especially simple manner to create a spoke-centered mounting of the seal carrier, in particular at the guide vanes.

A turbomachine according to the invention, in particular a gas turbine that has at least one compressor stage or turbine stage having a guide vane arrangement with guide vanes has, in accordance with the invention, a guide vane arrangement according to the invention and/or at least one guide vane according to the invention and/or at least one seal carrier according to the invention.

BRIEF DESCRIPTION OF THE DRAWING FIGURES

Figure 2:
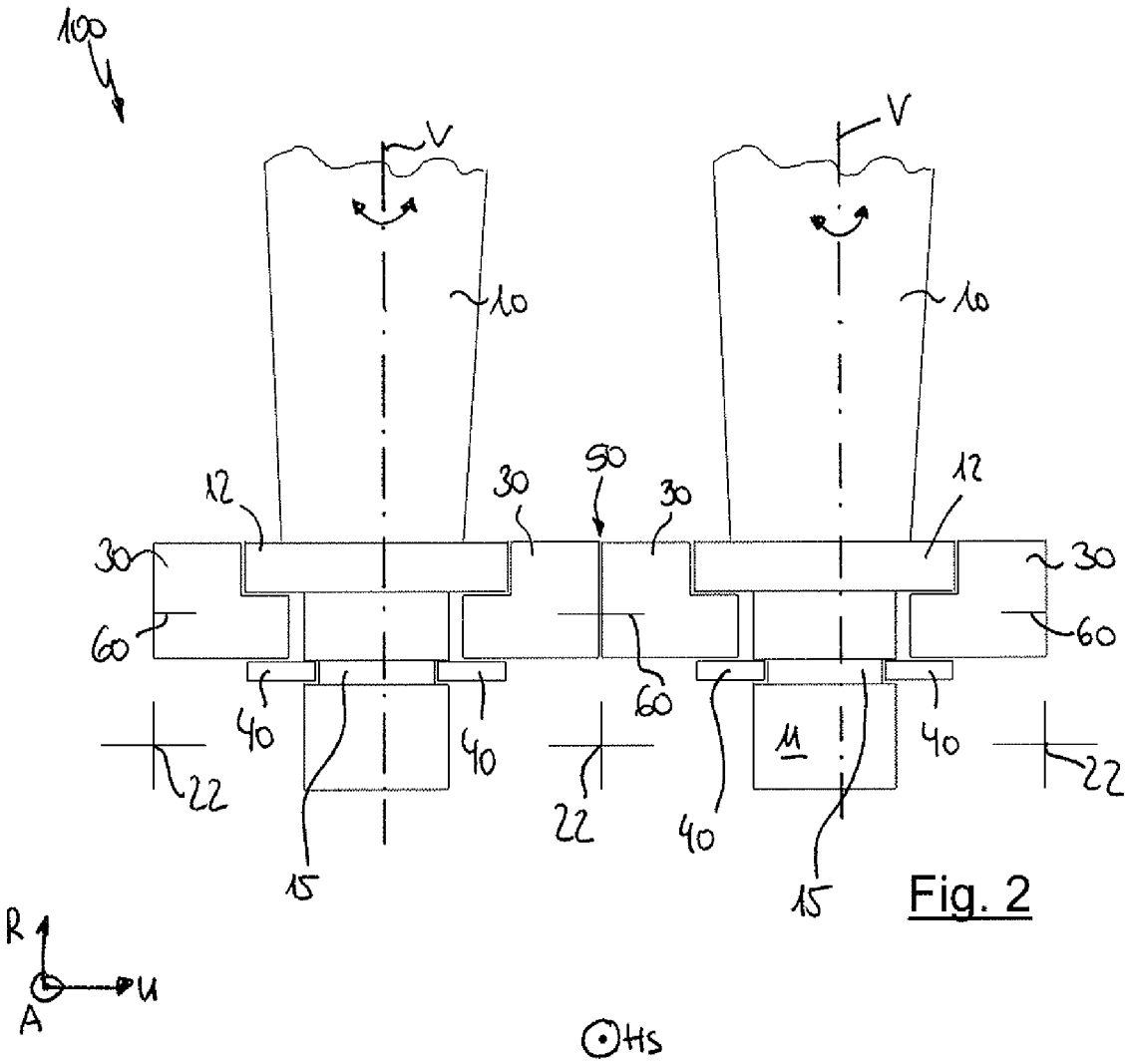

Additional advantageous enhancements of the present invention ensue from the dependent claims and from the following description of preferred embodiments. For this purpose, in a highly schematized manner:

FIG. 1 shows a schematic illustration of an excerpt from an exemplary embodiment of a guide vane arrangement according to the invention having a guide vane according to the invention and a seal carrier according to the invention, as viewed in the peripheral direction, and FIG. 2 shows the guide vane arrangement of FIG. 1 in a flattened illustration, as viewed in the axial direction, but without the seal carrier.

DESCRIPTION OF THE INVENTION

FIG. 1 shows a highly schematic illustration of an excerpt from an exemplary embodiment of a guide vane arrangement 100 according to the invention as viewed in the peripheral direction U onto the guide vane arrangement 100, wherein the guide vane arrangement 100 has an adjustable guide vane 10 according to the invention with a fastening pin 11 formed at its radially inner end, an inner ring segment 30 that is fastened to the guide vane 10, and a seal carrier 20 according to the invention, which is mounted at the fastening pin 11 so as to be able to move in the radial direction R.

In this case, the guide vane 10 is designed so as to rotate around an adjustment axis V, which, in this case, extends in the radial direction R, but also could be inclined to it, particularly by a few degrees, and is rotatably mounted with respect to the inner ring segment 30 as well as rotatably accommodated by the seal carrier 20.

Arranged at the radially inner end of the seal carrier 20 for sealing with respect to a rotor, which is not illustrated here, is a sealing structure, which is formed in a manner known from the prior art and has the form of a honeycomb sealing structure 21, and, in this exemplary embodiment, is formed, in particular integrally, with the downstream seal carrier part 20B.

For fixing the inner ring segment 30 in place at the guide vane 10, a circumferential groove 15 is introduced into the fastening pin 11 and can be engaged by an axial retaining means 40 in the form of a retaining ring 40, wherein the inner ring segment 30 is fastened to the guide vane 10 with a defined play in the direction of the adjustment axis V.

With its radially further outer-lying end, the fastening pin 11 abuts a shoulder 12 with a larger outer diameter, wherein, in relation to the adjustment axis, the circumferential radial groove 15 is introduced in the fastening pin 11 for receiving the axial retaining means 40 with a defined separating distance from this shoulder 12 of the guide vane 10 in the direction of the radial further inner-lying end of the fastening pin 11.

In the direction of the adjustment axis V between the guide vane 10 and the inner ring segment 30 in the radial direction, in particular in the region of a sealing gap 13 that acts in a radially sealing manner, the play is thereby, in particular, dimensioned such that, particularly in connection with the geometric embodiment of the inner ring segment 30, the application of an operating pressure p1 in a region radially within the inner ring segment 30 can press the inner ring segment 30 outward in the direction of the adjustment axis V, and, in the region of the sealing gap 13, which acts in a radially sealing manner, can be brought to rest against the guide vane 10, as a result of which an especially good sealing in the radial direction R in the region of the sealing gap 13 can be achieved.

For an especially good sealing, the shoulder 12 of the guide vane has an end face, which faces the radially inner end of the guide vane 10 and extends in a radial plane perpendicular to the adjustment axis V, wherein the end face is formed at least in part and preferably in full as a sealing surface and forms one of the two sealing surfaces of the sealing gap 13 that act in a radially sealing manner.

For fastening to the guide vane 10, the inner ring segment 30 has a fastening opening, which is not indicated here in detail, through which the radially inner end of the guide vane 10, in particular of the fastening pin 11, engages, wherein the guide vane 10 has a corresponding shoulder 12 as a stop in the radial direction radially outward and the inner ring segment 30 has a corresponding flange, which is not indicated here in detail.

In this case, the fastening pin 11, which engages through the fastening opening in the inner ring segment 30, is accommodated by the seal carrier 20 in a guide vane mount 24 that is formed appropriately correspondingly to the fastening pin, wherein, in this exemplary embodiment, the guide vane mount 24 is a cylindrically shaped depression and the fastening pin 11 is a cylindrical fastening pin 11.

The fastening pin 11 is thereby guided in the seal carrier 20 with a defined play, symbolized by a guiding gap 23, in the axial direction A and in the peripheral direction U, wherein, for this purpose, both a peripheral surface 27 of the fastening pin 11 and an inner surrounding surface of the guide vane mount 24 are each provided with a coating that reduces the friction coefficient and, furthermore, have a hardened surface in order to reduce the risk of fretting (rubbing wear).

In accordance with the invention, in this case, the seal carrier 20 is mounted at the guide vane 10 so as to be able to move in the direction of the adjustment axis V, which, in this case, coincides with the radial direction R, in a spoke-centered manner and in the direction of the adjustment axis V.

In this exemplary embodiment, the seal carrier 20 is thereby divided, on the one hand, in the axial direction A, and has a upstream seal carrier part 20A and a downstream seal carrier part 20B, which are connected to each other by way of a plurality of connection means 22 in the form of screws 22, which are arranged in a distributed manner in the peripheral direction, wherein the connection means 22 are each arranged at the level of the fastening pin 11 in the radial direction R, in order to make possible an especially compact and space-saving embodiment of the guide vane arrangement 100 in the radial direction R (see FIG. 2).

In addition to the axial division of the seal carrier 20, it is further divided in the peripheral direction U into a plurality of seal carrier segments, which cannot be seen in this illustration, wherein, in this case, the individual seal carrier segments each extend over no more than a peripheral angular region of 55°. The individual seal carrier parts or segments are each produced in this case by an additive manufacturing method.

The seal carrier segments that each adjoin one another in the peripheral direction are thereby arranged in overlap with respect to one another, both in the axial direction A and in the peripheral direction U, wherein the seal carrier segments in the regions of overlap are each wedge-shaped in form, as a result of which, in the region of overlap, an especially good sealing effect can be achieved, in particular in the axial direction A and in the peripheral direction U.

In this exemplary embodiment, in each case, the connection means 22 thereby connect two neighboring upstream seal carrier parts 20A to each other as well as, in addition, they connect the two associated downstream seal carrier parts 20B to each other, and, in addition, connect these to the two upstream seal carrier parts 20A. That is, by use of one connection means 22, in particular a screw 22, a total of four separate parts of a seal carrier 20 are connected to one another in this exemplary embodiment of a guide vane arrangement 100 according to the invention.

For a still further improved sealing, the downstream seal carrier part 20B as well as the inner ring segment 30 each have, on their downstream side, sealing flanges 25 and 35, respectively, which extend in the radial direction and which overlap in the radial direction R and in the peripheral direction U and form between them an axially acting sealing gap 26.

For an especially good sealing effect, the guide vane 10 is further connected to the inner carrier segment 30 in the region of its shoulder 12 in the axial direction A with a defined play, in particular with a defined axial play 14, in such a way that, through the application of a corresponding operating pressure p1 in conjunction with the geometric dimensions of the inner ring segment 30, it is possible to displace the inner ring segment 30 in the axial direction A in the direction of the sealing flange 25 of the seal carrier 20, and, in particular, to bring it to rest against the seal carrier 20, so that an axially acting sealing gap 26 having a gap width of zero is adjusted and hence a sealing of a flow channel, which, for this purpose, is designed for the passage of a flow of hot gas in a flow direction HS, is still further improved radially inward with respect to a region radially within the seal carrier 20, since, if hot gas leaks through the sealing gap 13, which acts in a radially sealing manner, the hot gas can still be prevented from leaking further radially inward by the axially acting sealing gap 26 that is arranged downstream.

As can readily be seen in FIG. 1, in a guide vane arrangement 100 according to the invention, the seal carrier 20 is movably mounted in the direction of the adjustment axis V or, in this case, also in the radial direction R with respect to the guide vane 10 as well as the inner ring segment 30 fastened to it. If, during operation, a thermally caused change in length of the guide vane 10 occurs, it is then possible for the fastening pin 11 to move freely in the guide vane mount 24 in the direction of the adjustment axis V or in the radial direction R, without this having a negative effect on the position of the sealing structure 21 and thus on a sealing gap that is formed with a rotor, which is not illustrated here, in the radial direction.

A change in length of the guide vane 10 also brings about a change in the gap width of the axially acting sealing gap 26 between the downstream seal carrier part 20B and the inner ring segment 30.

Because the inner ring segment 30 is fixed in place at the guide vane 10, it follows the change in length of the guide vane 10, so that there is also no change in the gap width of the sealing gap 13, which acts in a radially sealing manner.

Accordingly, a guide vane arrangement 100 according to the invention makes it possible to achieve gap widths over a broad operating range and thus high efficiencies over a broad operating range.

Furthermore, the spoke-centered mounting of the seal carrier 20, which, in accordance with the invention, is decoupled from the inner ring segment 30, brings about a separation of the tolerance chain and thus a markedly simpler determination of the maximum allowed tolerances, in order to determine the maximum gap widths desired in each case or the maximum allowed tolerances for the maximum gap widths desired in each case.

FIG. 2 shows the guide vane arrangement 100 of FIG. 1 as viewed in the axial direction A in the flow direction HS in an unwound flattened state, wherein, in this illustration, it can be readily seen, in particular, how, in each case, two inner ring segments 30 are arranged with respect to each other in the peripheral direction U with a defined compensation gap 50 in between in order to prevent stresses in the peripheral direction, whereby, in the region of the compensation gap 50, in each case, a sealing element 60 is arranged, in particular in the form of a sealing strip 60 made of spring steel, which, in each case, is introduced into a groove in the two neighboring inner ring segments and extends in the axial direction A, in particular over the length of the inner ring segments 30 as well as over a certain portion in the peripheral direction U in order to effect a sealing in the radial direction R between the inner ring segments 30. The sealing element 60 thereby forms, in each case, a labyrinth gap with the associated inner ring segment 30.

Also readily seen in this illustration is the position of each of the individual connecting elements 22 that lie between two guide vanes 10 and are displaced relative to them and, in particular, in each case, are situated at the level of the fastening pin 11 in the radial direction R for an especially space-saving and compact embodiment of a guide vane arrangement 100 according to the invention in the radial direction.

It is noted that what is involved here in the case of the exemplary embodiments are merely examples, which are not intended in any way to limit the protective scope, the applications and the structure. Instead, the preceding description provides the person skilled in the art with a guideline for the implementation of at least one exemplary embodiment, wherein diverse changes can be made, in particular in terms of the function and arrangement of the structural parts described, without leaving the protective scope as it ensues from the claims and the combinations of features that are equivalent to them.

What is claimed is:

1. A guide vane arrangement for a turbomachine with an axis of rotation, for a compressor stage or a turbine stage of a gas turbine, comprising:

a plurality of adjustable guide vanes, each of which is rotatably mounted around an adjustment axis, at least one inner ring segment that is formed separately from the guide vanes, and a seal carrier that is formed separately from the at least one inner ring segment, wherein the at least one inner ring segment is fastened to one guide vane or to a plurality of guide vanes such that the at least one inner ring segment is fixed in place at the guide vane in the direction of the adjustment axis, wherein the seal carrier is mounted in a spoke-centered manner with respect to the at least one inner ring segment, so that the seal carrier is movably mounted with respect to the at least one inner ring segment in the direction of at least one adjustment axis, of at least one guide vane, and/or in the radial direction in relation to the axis of rotation of the turbomachine in a functional state of use of the guide vane arrangement in a turbomachine wherein the seal carrier is divided at least in part along a plane of division that is parallel to the adjustment axis of the guide vanes and/or along a radial plane that extends perpendicular to the axis of rotation into at least one upstream seal carrier part and at least one downstream seal carrier part; and wherein the at least one upstream seal carrier part and the at least one downstream seal carrier part are connected to each other by way of at least one connector that extends in a direction perpendicular to the plane of division of the seal carrier, wherein the at least one connector is arranged in the peripheral direction displaced with respect to the fastening elements of the guide vanes and is situated in the radial direction at the level of at least one fastening element of at least one guide vane.

2. The guide vane arrangement according to claim 1, wherein the seal carrier is mounted in a spoke-centered manner at the guide vanes, by way of at least three bearing points that are arranged in a distributed manner in the peripheral direction.

3. The guide vane arrangement according to claim 1, wherein at least one guide vane has at its radially inner end a fastening element, which extends along the adjustment axis, and the at least one inner ring segment, which is fastened to this at least one guide vane, has at least one associated, correspondingly formed fastening opening, wherein the fastening element of the guide vane engages all the way through the at least one, associated fastening opening of the inner ring segment.

4. The guide vane arrangement according to claim 3, wherein the at least one inner ring segment is fastened to the fastening element by an axial retainer and is retained in the direction of the adjustment axis on the fastening element, wherein the retaining element is a retaining ring or a retaining washer.

5. The guide vane arrangement according to claim 3, wherein the seal carrier has at least one guide vane mount, in which the fastening element of at least one guide vane engages in such a way that the fastening element of the guide vane is movably mounted in the guide vane mount of the seal carrier with respect to the seal carrier along the adjustment axis and/or in the radial direction.

6. The guide vane arrangement according to claim 1, wherein the seal carrier is a circumferentially formed seal carrier ring, wherein the seal carrier ring is formed in the peripheral direction at least in part in one piece, or has a plurality of seal carrier segments, each of the plurality of seal carrier segments extends over only a portion of the seal carrier ring in the peripheral direction.

7. The guide vane arrangement according to claim 1, wherein at least one inner ring segment and the seal carrier overlap at least in part downstream in the direction of the adjustment axis and form a sealing gap that acts in a sealing manner in the axial direction.

8. The guide vane arrangement according to claim 1, wherein the guide vane arrangement has at least two inner ring segments, which are formed separately from the guide vanes, wherein the at least two inner ring segments are arranged next to each other in the peripheral direction and have a compensation gap in the peripheral direction in between, wherein between two inner ring segments arranged next to each other in the peripheral direction, at least one sealing element is arranged in the region of the compensation gap for at least partial sealing of the compensation gap in the radial direction.

9. The guide vane arrangement according to claim 1, wherein each of the plurality of adjustable guide vanes, in relation to the axis of rotation of the turbomachine, has a radially outer end and a radially inner end, wherein, in the region of the radially inner end of the guide vane, an inner ring segment can be fastened to the guide vane, and, at its radially inner end, the guide vane has a fastening pin, which extends along the adjustment axis and, for this purpose, is formed to interact with a fastening recess of an inner ring segment that can be fastened to the guide vane to engage through a fastening opening, wherein a radial groove, which is circumferential in relation to the adjustment axis, is introduced for receiving an axial retainer.

10. The guide vane arrangement according to claim 9, wherein the fastening pin, in relation to the axis of rotation of the turbomachine, abuts by its radially further outer-lying end a shoulder with a larger outer diameter, wherein the circumferential radial groove is introduced into the fastening pin for receiving the axial retainer with a defined separating distance from this shoulder of the guide vane in the direction of the radially further inner-lying end of the fastening pin.

11. The guide vane arrangement according to claim 10, wherein the shoulder has an end face that faces the radially inner end of the guide vane and extends in a radial plane perpendicular to the adjustment axis, wherein the end face is formed at least in part as a sealing surface.

12. The guide vane arrangement claim 1, wherein the seal carrier is formed for spoke-centered mounting at guide vanes and has at least one guide vane mount for receiving a fastening element of a respective guide vane, in which the fastening element of a respective guide vane can engage in such a way that the fastening element of the respective guide vane can be movably mounted in the guide vane mount of the seal carrier along the adjustment axis or longitudinal axis of the guide vane and/or in the radial direction, in relation to an axis of rotation of the turbomachine, with respect to the seal carrier, and can be rotatably mounted around the adjustment axis of the guide vane.

13. The guide vane arrangement according to claim 1, the at least one upstream seal carrier part is formed separately from the at least one downstream seal carrier part.

* * * * *